US010418768B1

(12) United States Patent
Xiao

(10) Patent No.: US 10,418,768 B1
(45) Date of Patent: Sep. 17, 2019

(54) ROTATING SOCKET

(71) Applicant: NANNING FUGUI PRECISION INDUSTRIAL CO., LTD., Nanning (CN)

(72) Inventor: Dai-Ge Xiao, Shenzhen (CN)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 0 days.

(21) Appl. No.: 16/229,323

(22) Filed: Dec. 21, 2018

(30) Foreign Application Priority Data

Oct. 19, 2018 (CN) ..... 2018 1 1224092

(51) Int. Cl.

| | |
|---|---|
| ***H01R 39/00*** | (2006.01) |
| ***H01R 35/04*** | (2006.01) |
| ***H01R 13/14*** | (2006.01) |
| *H01R 13/512* | (2006.01) |
| *H01R 13/73* | (2006.01) |

(52) U.S. Cl.
CPC ..... *H01R 35/04* (2013.01); *H01R 13/14* (2013.01); *H01R 13/512* (2013.01); *H01R 13/73* (2013.01)

(58) Field of Classification Search
CPC ..... H01R 35/04
USPC ..... 439/13, 21, 22
See application file for complete search history.

(56) References Cited

U.S. PATENT DOCUMENTS

| | | | | |
|---|---|---|---|---|
| 5,484,299 | A * | 1/1996 | Schlessinger | H01R 13/4532 200/51.1 |
| 6,370,020 | B1 * | 4/2002 | Toukairin | F16M 11/08 174/86 |
| 6,638,074 | B1 * | 10/2003 | Fisher | H01R 35/04 439/18 |
| 7,121,834 | B2 * | 10/2006 | Gerard | H01R 35/04 439/21 |
| 7,238,028 | B2 * | 7/2007 | Gerard | H01R 13/652 439/188 |
| 7,500,854 | B2 * | 3/2009 | Gottstein | H01R 25/006 439/13 |
| 7,740,484 | B1 * | 6/2010 | Chiang | H01R 24/76 439/13 |

(Continued)

FOREIGN PATENT DOCUMENTS

| | | |
|---|---|---|
| CN | 204361400 U | 5/2015 |
| CN | 204885542 U | 12/2015 |

(Continued)

*Primary Examiner* — Neil Abrams
(74) *Attorney, Agent, or Firm* — ScienBiziP, P.C.

(57) ABSTRACT

A rotating socket comprises a wiring assembly, a rotating assembly, an elastic member, a locking mechanism, and a housing. The wiring assembly comprises a fixing base and lugs, the fixing base comprises a substrate and a side wall. The rotating assembly comprises a panel, a rotating base, conductive tabs and conductive rings. The locking mechanism controlling whether the rotating base is separated from the fixing base. When the locking mechanism is in a locked state, the rotating base compresses the elastic member, and one end of the rotating base away from the panel abuts against the substrate and is limited by the side wall; when the locking mechanism is in a unlocked state, the rotating base is separated from the fixed base by resilient force of the elastic member and free to be rotated.

20 Claims, 7 Drawing Sheets

(56) References Cited

U.S. PATENT DOCUMENTS

| | | | | |
|---|---|---|---|---|
| 7,753,682 | B2 * | 7/2010 | Gerard | H01R 13/652<br>439/13 |
| 9,450,365 | B1 * | 9/2016 | Baldwin | H01R 35/04 |
| 9,821,671 | B2 * | 11/2017 | Mueller | B60L 11/1818 |
| 10,033,144 | B1 * | 7/2018 | Patterson | H01R 25/006 |

FOREIGN PATENT DOCUMENTS

| | | | |
|---|---|---|---|
| CN | 207069129 | U | 3/2018 |
| TW | M397095 | U | 1/2011 |
| TW | I370595 | B | 8/2012 |

* cited by examiner

ROTATING SOCKET

FIELD

The disclosure generally relates to electrical sockets.

BACKGROUNDING

Electrical sockets are found everywhere. However, most sockets cannot change the orientation of the jacks or terminals, which may cause problems in use, and in some cases difficulty in inserting and removing of plugs, especially for three-hole sockets fixed on the wall.

Therefore, there is room for improvement within the art.

BRIEF DESCRIPTION OF THE DRAWING

Many aspects of the present disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION OF EMBODIMENTS

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts have been exaggerated to better illustrate details and features of the present disclosure. The description is not to be considered as limiting the scope of the embodiments described herein.

Several definitions that apply throughout this disclosure will now be presented. The term "comprising" means "including, but not necessarily limited to"; it specifically indicates open-ended inclusion or membership in a so-described combination, group, series and the like. The term "coupled" is defined as connected, whether directly or indirectly through intervening components, and is not necessarily limited to physical connecting. The connecting can be such that the objects are permanently connected or releasably connected.

Figure 1:
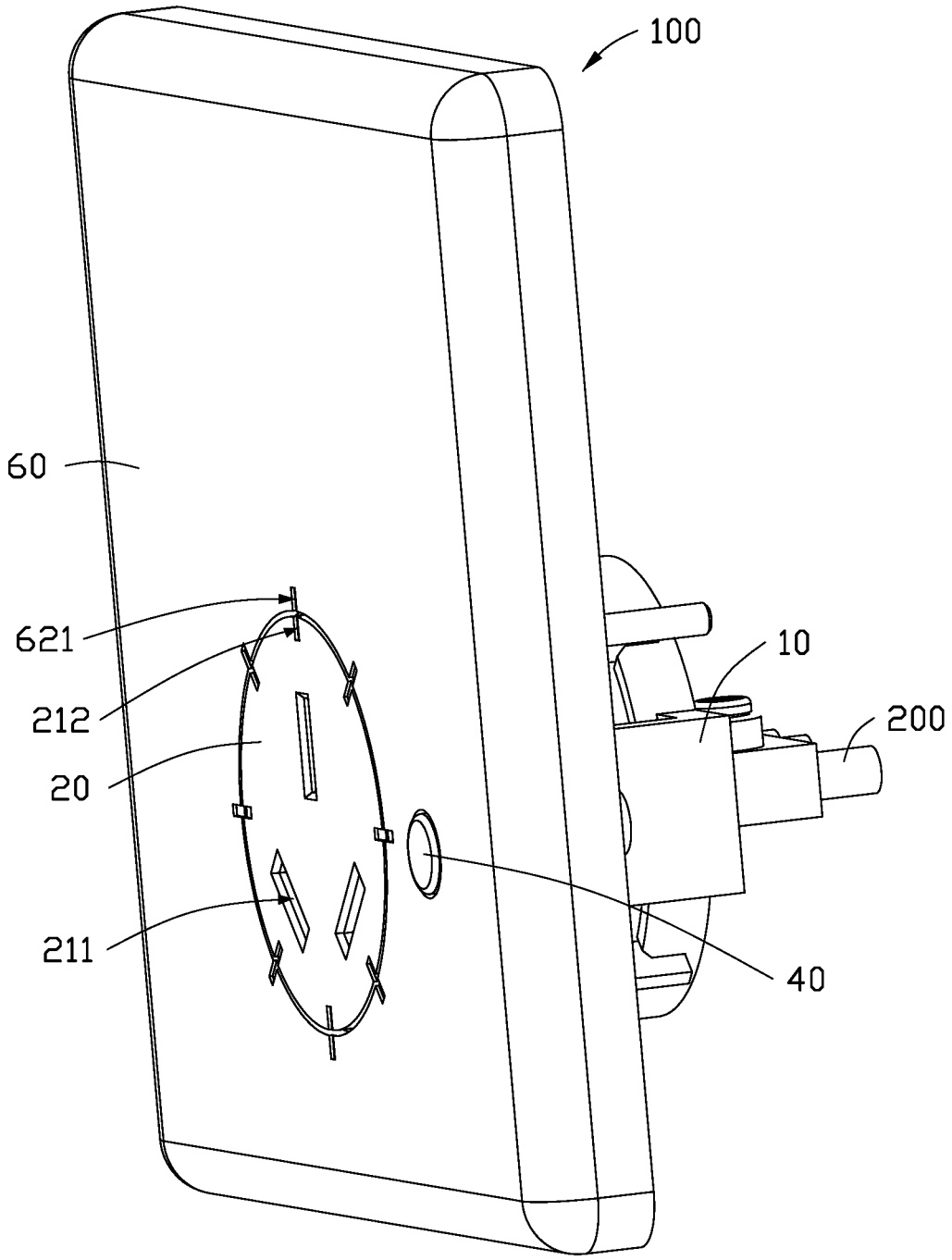
FIG. 1 is a perspective view of a rotating socket and electric wires in accordance with an embodiment of the present disclosure.
Figure 2:
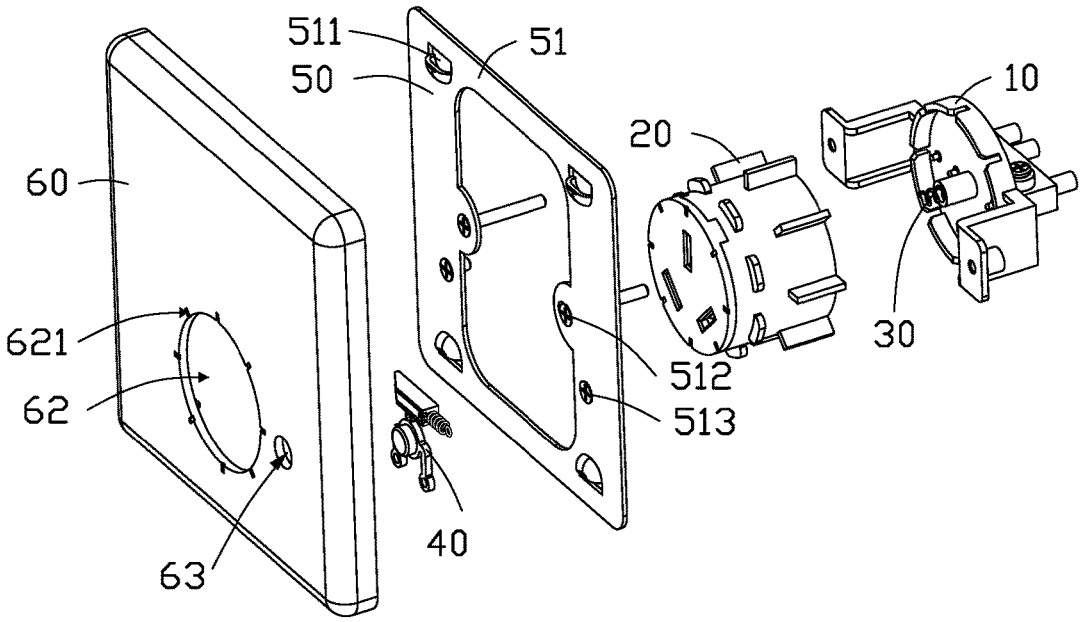
FIG. 2 is a partially exploded perspective view of the rotating socket as shown in FIG. 1.

Referring to FIG. 1 and FIG. 2, an embodiment of the present disclosure provides a rotating socket 100 for receiving a model-matched plug to take power. The rotating socket 100 includes a wiring assembly 10, a rotating assembly 20, an elastic member 30, a locking mechanism 40, a bracket 50, and a housing 60.

The wiring assembly 10 is fixed to the bracket 50 and electrically connected to electric wires 200 of a power supply. The rotating assembly 20 can be in latched with the wiring assembly 10. The rotating assembly 20 can also be rotated relative to the wiring assembly 10 when separated from the wiring assembly 10. The elastic member 30 cooperates with the locking mechanism 40 to control whether the rotating assembly 20 is separated from the wiring assembly 10.

Figure 3:
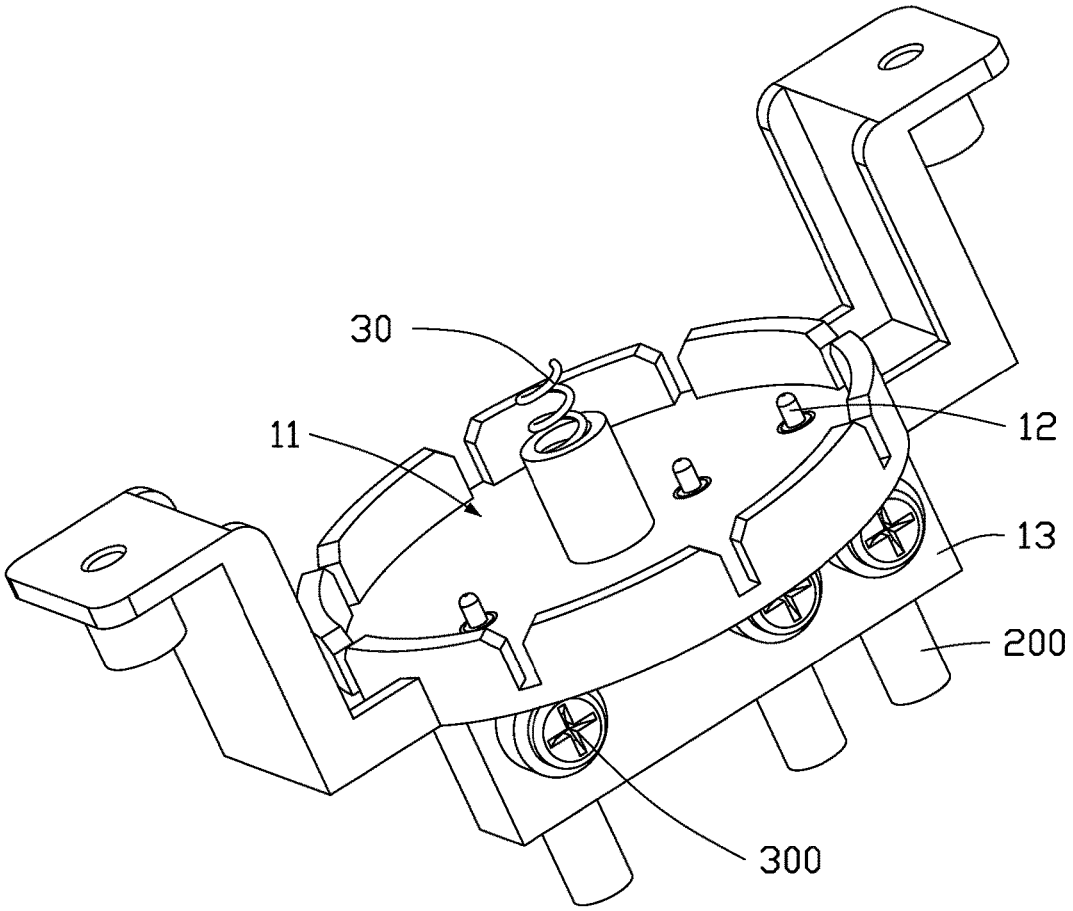
FIG. 3 is a perspective view of a wiring assembly of the rotating socket as shown in FIG. 2.
Figure 4:
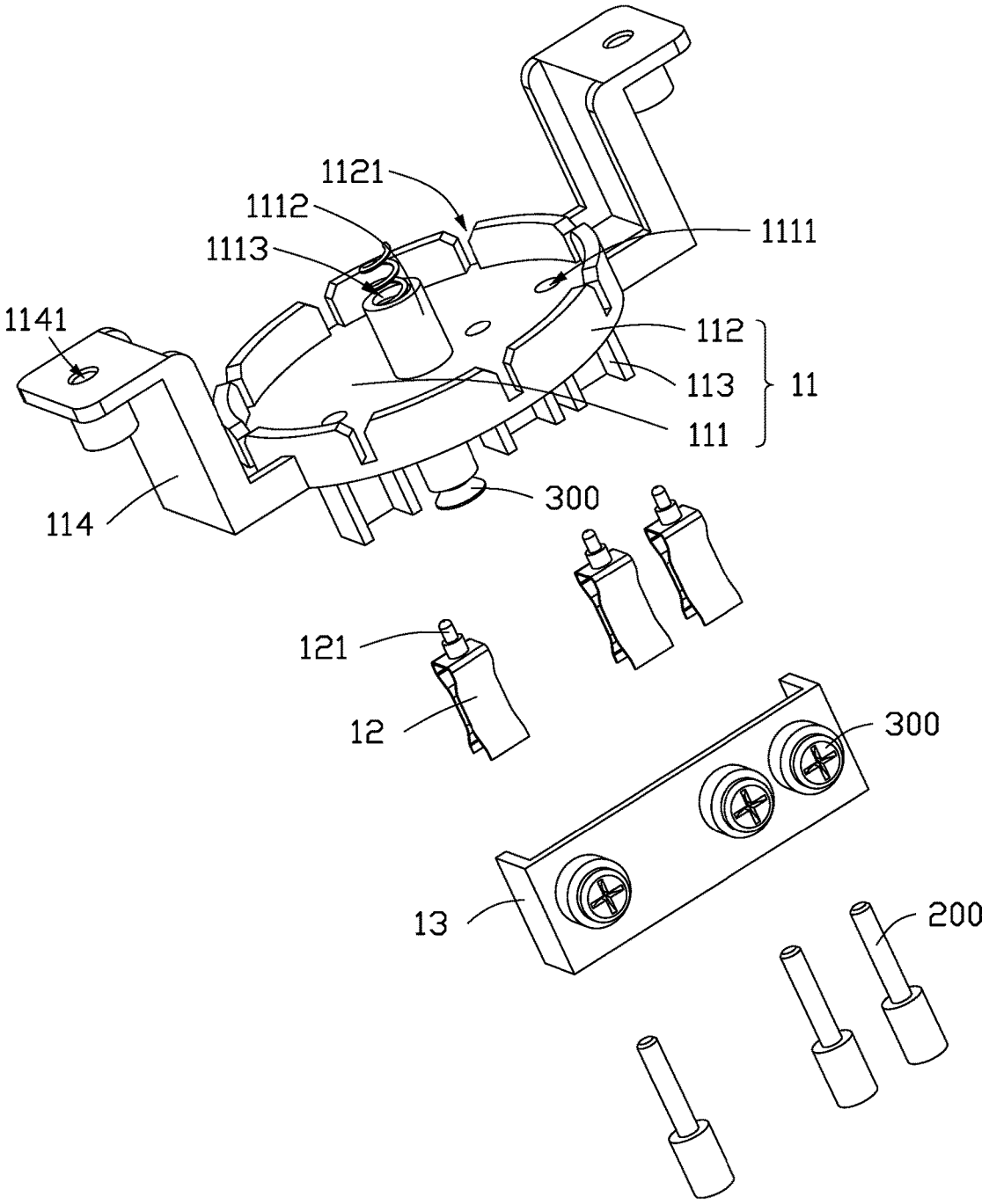
FIG. 4 is an exploded perspective view of the wiring assembly as shown in FIG. 3.

Referring to FIG. 3 and FIG. 4, the wiring assembly 10 includes a fixing base 11, a plurality of lugs 12, and a wire cover 13. The fixing base 11 includes a substrate 111, a side wall 112, and a terminal block 113. The side wall 112 and the terminal block 113 are extended from the substrate 111 and located on opposite sides of the substrate 111. The terminal block 113 is coupled with the wire cover 13 to fix the lugs 12 to be electrically connected to the electric wires 200.

In the present embodiment, there are three lugs 12. The three lugs 12 are respectively connected to a live wire, a null wire, and a ground wire. The lug 12 can be made of a conductive material such as copper. The fixing base 11 and the wire cover 13 are made of insulating materials.

In the present embodiment, the fixing base 11 is an integrally formed structure. In other embodiments, the fixing base 11 can be a non-integral structure. An integrally formed fixing base 11 can make its self-connection more firm and more convenient to assemble with other components.

The lug 12 has a shape of U with an open end, the open end of the lug 12 enables the electric wire 200 to be inserted and electrically connected with the electric wire 200. The other end away from the open end of the lug 12 includes a connecting protrusion 121.

The substrate 111 defines a plurality of through holes 1111. The number of through holes 1111 is equal to that of the lugs 12. Each connecting protrusion 121 is received in a through hole 1111 and protrudes out from the through hole 1111 to electrically connect to the rotating assembly 20.

When the wiring assembly 10 is connected to the electric wires 200, the lugs 12 are firstly placed on the terminal block 113, and one end of each of the lug 12 having the connecting protrusion 121 is directed toward the substrate 111 so that the connecting protrusion 121 penetrates a through hole 1111. One end of each of the electric wires 200 is inserted into the open end of a lug 12. The wire cover 13 is placed on the terminal block 113 and coupled to the terminal block 113 by screws 300. The screw 300 can be screwed into the wire cover 13 to press the open end of the lug 12 so that the open end of the lug 12 can be electrically connected to the electric wire 200.

Figure 5:
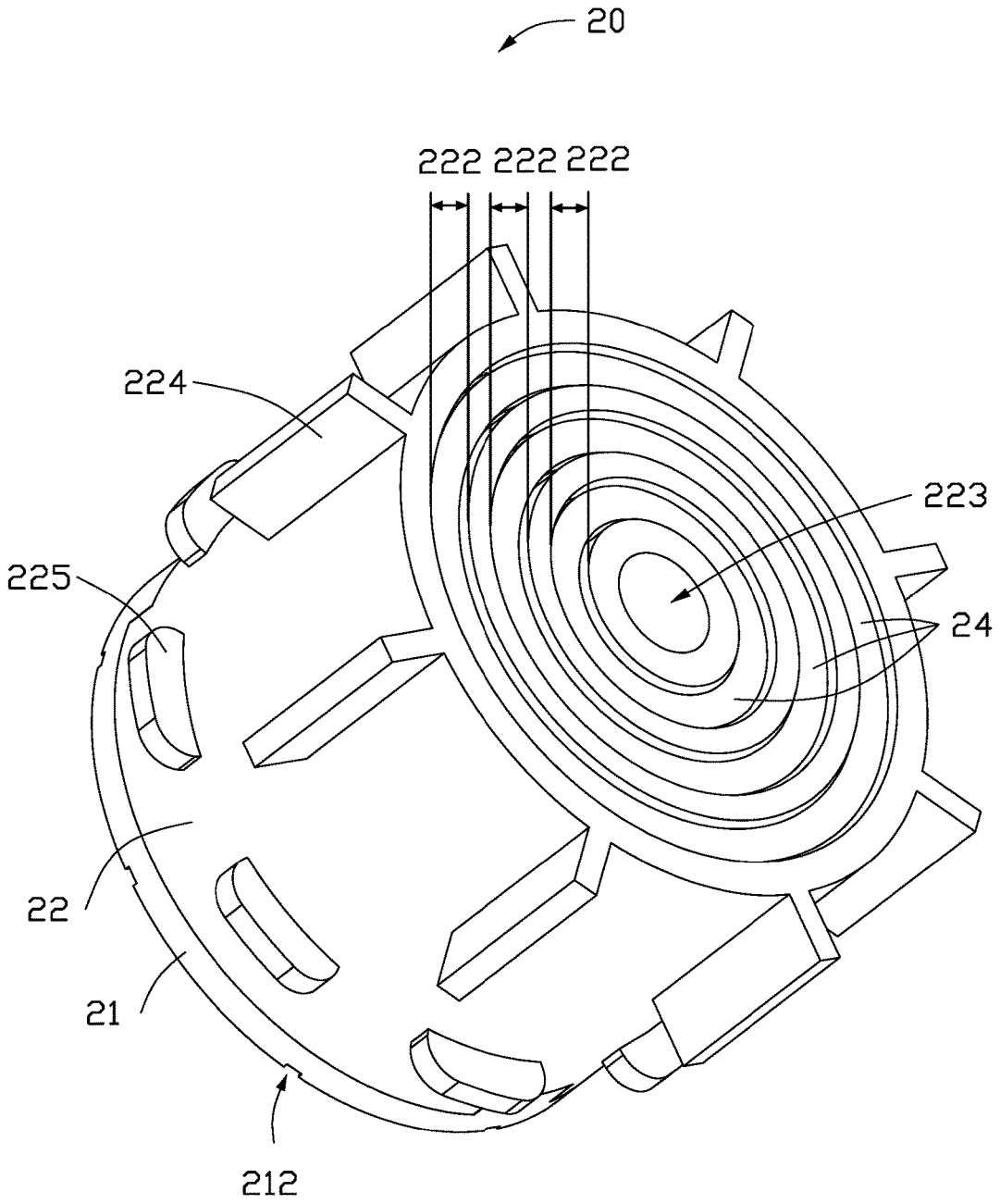
FIG. 5 is a perspective view of a rotating assembly of the rotating socket as shown in FIG. 1.
Figure 6:
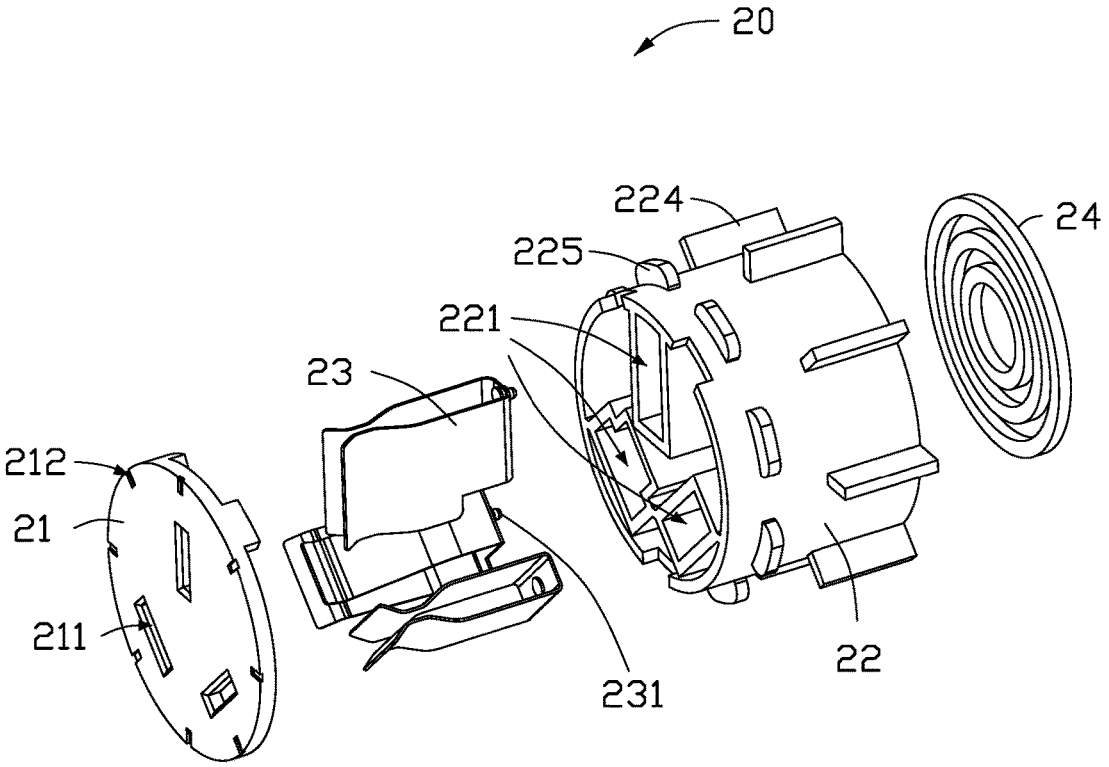
FIG. 6 is an exploded perspective view of the rotating assembly as shown in FIG. 5.

Referring to FIG. 5 and FIG. 6, the rotating assembly 20 includes a panel 21, a rotating base 22, a plurality of conductive tabs 23, and a plurality of conductive rings 24. The plurality of conductive tabs 23 and the plurality of conductive rings 24 are received in the rotating base 22. The panel 21 defines a plurality of jacks 211, and the number of jacks 211, of conductive tabs 23, and of conductive rings 24 are equal to the number of lugs 12. The conductive tab 23 and the conductive ring 24 can be made of a conductive material such as copper.

In the present embodiment, the conductive tab 23 has a shape of U with an open end bent to receive and clamp the plug. One end of the conductive tab 23 away from the open end has a conductive protrusion 231. Each of the conductive tabs 23 is in electrical contact with a conductive ring 24 via a conductive protrusion 231.

One side of the rotating base 22 adjacent to the panel 21 defines a plurality of first receiving grooves 221 corresponding to the jacks 211. One side of the rotating base 22 away from the panel 21 defines a plurality of second receiving grooves 222 corresponding to the first receiving grooves 221. Each of the first receiving grooves 221 communicates with a second receiving groove 222 through a channel.

Each of the conductive tabs 23 is received in a first receiving groove 221. Each of the conductive rings 24 is received in a second receiving groove 222. The conductive protrusion 231 of the conductive tab 23 is electrically connected to a conductive ring 24 through the above-mentioned channel.

Referring to FIG. 4 and FIG. 5, one side of the substrate 111 adjacent to the rotating base 22 has a rotating shaft 1112. One side of the rotating base 22 adjacent to the substrate 111 defines a rotating shaft slot 223. The rotating shaft 1112 is received in the rotating shaft slot 223 to enable the rotating base 22 to rotate around the rotating shaft 1112.

The rotating shaft 1112 defines a sinking groove 1113, and the elastic member 30 is received in the sinking groove 1113. Specifically, the elastic member 30 can be a spring having a free length greater than the depth of the sinking groove 1113.

In the present embodiment, the depth of the rotating shaft slot 223 coincides with the length of the rotating shaft 1112. Therefore, when the side of the rotating base 22 away from the panel 21 abuts against the substrate 111, the elastic member 30 is in a compressed state.

When the rotating base 22 abuts against the substrate 111, the connecting protrusion 121 protrudes through the through hole 1111 to contact the conductive ring 24. Each conductive tab 23 is electrically therefore connected to a lug 12 via a conductive ring 24.

In the present embodiment, the substrate 111 has a shape of circle, the rotating base 22 has a shape of cylinder with a diameter coincident with the diameter of the substrate 111. Therefore, when the rotating base 22 abuts against the substrate 111, the rotating base 22 is limited by the side wall 112.

The side wall 112 defines a plurality of latching slots 1121. The rotating base 22 defines a plurality of latching protrusions 224. In the present embodiment, the latching slots 1121 are evenly spaced along the circumferential direction of the side wall 112, and the latching protrusions 224 are evenly spaced along the circumferential direction of the rotating base 22. The number of the latching slots 1121 is equal to that of the latching protrusions 224. Therefore, when the rotating base 22 abuts against the substrate 111, each of the latching protrusions 224 is restrained and received in a latching slot 1121.

Figure 7:
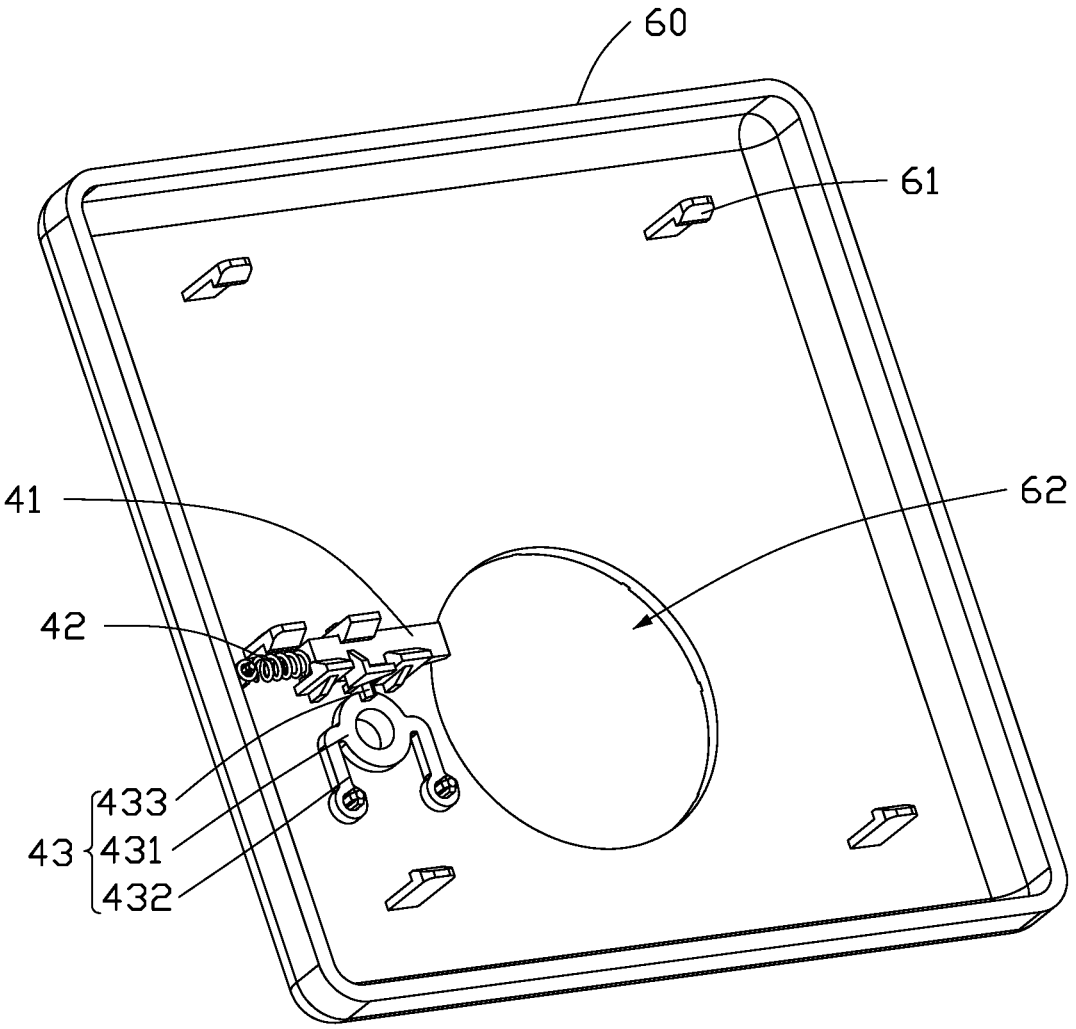
FIG. 7 is a perspective view of a housing and a locking mechanism of the rotating socket as shown in FIG. 1.

Referring to FIG. 7, the locking mechanism 40 controls whether the rotating base 22 is separated from the fixing base 11. When the locking mechanism 40 is in a locked state, the rotating base 22 compresses the elastic member 20 and abuts against the substrate 111, being limited to the side wall 112. When the locking mechanism 40 is in an unlocked state, the rotating base 22 is forced away from the fixing base 11 by an resilient force of the elastic member 30.

The locking mechanism 40 is coupled to the housing 60 and includes a sliding wedge 41, a telescopic member 42, and a button 43. Pressing the button 43 drives the sliding wedge 41 to slide along the housing 60. When the pressure applied to the button 43 is removed, the telescopic member 42 slides along the housing 60 under an resilient force of the telescopic member 42. In the present embodiment, the telescopic member 42 can be a spring. In other embodiments, the telescopic member can be a resilient cord.

The button 43 includes a pressing portion 431, a fixing portion 432, and a wedge rib 433. The fixing portion 432 is fixed to the housing 60. The wedge rib 433 abuts against the sliding wedge 41 and pushes the sliding wedge 41 to slide when the pressing portion 431 is pressed. In the present embodiment, the sliding wedge 41 has an inclined surface. When the pressing portion 431 is depressed, the wedge rib 433 slides along the inclined surface, and the wedge rib 433 slides from a higher position to a lower position.

Referring to FIG. 5, limiting protrusions 225 extend from the rotating base 22 along a circumferential direction, the limiting protrusions 225 are located on the side of the rotating base 22 adjacent to the panel 21. When the locking mechanism 40 is in the locked state, the sliding wedge 41 abuts against one of the limiting protrusions 225, so that the rotating base 22 is limited between the sliding wedge 41 and the fixing base 22. In the present embodiment, when the rotating base 22 is limited between the sliding wedge 41 and the fixing base 22, the panel 21 is flush with the surface of the housing 60.

When the sliding wedge 41 is controlled by the button 43 to slide away from the limiting protrusion 225 along the housing 60, the pressure of the elastic member 30 is reduced. Therefore, the elastic member 30 is elongated to push the rotating base 22 away from the fixing base 11 and protrude from the surface of the housing 60. At this time, the rotating base 22 is separated from the fixing base 11, and the latching protrusion 224 is separated from the latching slot 1121, so that the rotating base 22 can freely rotate relative to the fixing base 11.

When the rotating base 22 is separated from the fixing base 11, the connecting protrusion 121 of the lug 12 ceases to be in contact with the conductive ring 24, thus the conductive tab 23 and the lug 12 are not electrically connected, thereby withholding power to protect users' safety.

The rotating socket 100 provided by the present embodiment realizes an orientation change of the jacks 211 by rotating the rotating assembly 20, and facilitates plugging and unplugging of the plug from multiple orientations.

In addition, after an orientation change of the jacks 211, the rotating base 22 is pushed to move toward the fixing base 11, so that the elastic member 30 is compressed and shortened. The latching protrusion 224 is again stuck in the latching slot 1121, and the panel 21 is again flush with the surface of the housing 60. At the same time, the pressure applied to the pressing portion 431 is released, and the sliding wedge 41 slides along the housing 60 until it abuts against one of the limiting protrusions 225, thereby returning the locking mechanism 40 to the locked state.

In the present embodiment, the conductive ring 24 has a shape of circle and is three in number. Diameters of the three conductive rings 24 are different. The three conductive rings 24 are disposed coaxially with the rotating shaft slot 223. Therefore, rotating the rotating base 22 does not affect the electrical contact between the lug 12 and the conductive ring 24. Thereby, the electrical connection between the conductive tab 23 and the electric wire 200 is not affected by the rotation of the rotating base 22.

The housing 60 defines a socket hole 62 for receiving the panel 21 and a button hole 63 for receiving the pressing portion 431 of the button 43.

A plurality of outer scale lines 621 are formed around edge of the socket hole 62, and the outer scale lines 621 being distributed in one-to-one correspondence with the latching slots 1121.

A plurality of inner scale lines 212 are formed around an edge of the panel 21, and the inner scale lines 212 are distributed in one-to-one correspondence with the latching protrusions 224. Rotating the rotating base 22 to align the outer scale lines 621 and the inner scale lines 212 one-to-one is advantageous for ensuring that the latching protrusions 224 are limited to being received in the latching slots 1121.

Referring to FIG. 2 and FIG. 7, the bracket 50 includes an annular frame 51. One side of the frame 51 adjacent to the housing 60 has a plurality of latching members 511. One side of the housing 60 adjacent to the frame 51 has a plurality of hooks 61. The hooks 61 can be engaged with the latching members 511.

In the present embodiment, the frame 51 has a rectangular shape, the number of latching members 511 is four, and the four latching members 511 are located at the four corners of the frame 51. The number of hooks 61 is equal to that of the latching members 511, and each latching member 511 is engaged with a hook 61 to detachably fix the housing 60 to the bracket 50.

The frame 51 defines a plurality of mounting holes 512 and a plurality of fitting holes 513. The mounting holes 512 allow screws 300 to pass through to securely attach the bracket 50 to a fixed structure such a wall. The fitting holes 513 allow the screws 300 to pass through to securely connect the wire assembly 10 to the bracket 50.

Referring to FIG. 4, in the present embodiment, the fixing base 11 further includes two fixing arms 114 for fixed attachment to the bracket 50. The end of each of the two fixing arms 114 away from the substrate 111 defines a threaded groove 1141. When the wiring assembly 10 is coupled to the bracket 50, the screw 300 passes through the fitting hole 513 and is screwed into the thread groove 1141.

The embodiments shown and described above are only examples. Many details are often found in the art such as the other features of a rotating socket. Therefore, many such details are neither shown nor described. Even though numerous characteristics and advantages of the present technology have been set forth in the foregoing description, together with details of the structure and function of the present disclosure, the disclosure is illustrative only, and changes can be made in the detail, including in matters of shape, size and arrangement of the parts within the principles of the present disclosure up to, and including the full extent established by the broad general meaning of the terms used in the claims. It will therefore be appreciated that the embodiments described above can be modified within the scope of the claims.

What is claimed is:

1. A rotating socket, comprising:

a wiring assembly comprising a fixing base comprising a substrate and a side wall extending outward from the substrate, and a plurality of lugs passing through the substrate and being electrically connected to electric wires for energizing;

a rotating assembly comprising a panel with a plurality of j acks, a rotating base located on one side of the panel, and a plurality of conductive tabs and a plurality of conductive rings received in the rotating base;

an elastic member located between the fixing base and the rotating base;

a locking mechanism configured for controlling whether the rotating base is separated from the fixing base; and a housing with a socket hole for receiving the panel;

wherein, numbers of the jacks, the conductive tabs, the conductive rings and the lugs are same, each of the plurality of conductive tabs is electrically connected to one of the conductive rings, and each of the plurality of conductive rings is detachably electrically connected to one of the lugs;

wherein, when the mechanism is in a locked state, the rotating base compresses the elastic member, and the end of the rotating base away from the panel abuts against the substrate and is limited by the side wall; and wherein, when the locking mechanism is in an unlocked state, the rotating base is separated from the fixing base by resilient force of the elastic member.

2. The rotating socket as claimed in claim 1, wherein the side wall defines a plurality of latching slots, the rotating base defines a plurality of latching protrusions, the number of latching slots is equal to that of the latching protrusions, and each of the plurality of protrusions is restrained and received in one of the latching slots when the rotating base abuts against the substrate.

3. The rotating socket as claimed in claim 2, wherein the substrate has a shape of circle and the side wall extends from the edge of the substrate, the latching slots are evenly spaced along a circumferential direction of the side wall; the rotating base has a shape of cylinder, the latching protrusions are evenly spaced along a circumferential direction of the rotating base.

4. The rotating socket as claimed in claim 2, wherein a plurality of outer scale lines are formed around an edge of the socket hole, and the outer scale lines are distributed in one-to-one correspondence with the latching slots; a plurality of inner scale lines are formed around an edge of the panel, and the inner scale lines are distributed in one-to-one correspondence with the latching protrusions.

5. The rotating socket as claimed in claim 1, wherein a side of the substrate that is adjacent to the rotating base has a rotating shaft, a side of the rotating base that is adjacent to the substrate has a rotating shaft slot, and the rotating shaft is received in the rotating shaft slot to enable the rotating base to rotate around the rotating shaft.

6. The rotating socket as claimed in claim 5, wherein the rotating shaft has a sinking groove for receiving the elastic member.

7. The rotating socket as claimed in claim 6, wherein a depth of the rotating shaft slot coincides with a length of the rotating shaft, and a free length of the elastic member is greater than a depth of the sinking groove.

8. The rotating socket as claimed in claim 5, wherein the conductive ring has a shape of circle, and the conductive rings have different diameters and are positioned coaxially with the rotating shaft slot.

9. The rotating socket as claimed in claim 1, wherein the wiring assembly further comprises a wire cover, the fixing base further comprises a terminal block extending from the substrate, and the terminal block is coupled with the wire cover to fix the lugs to be electrically connected to the electric wires.

10. The rotating socket as claimed in claim 1, wherein each lug has a shape of U with an open end, and the other end away from the open end has a connecting protrusion.

11. The rotating socket as claimed in claim 10, wherein the substrate defines a plurality of through holes, the number of though holes is equal to that of the lugs, each connecting protrusion is received in one of the through holes and protrudes from the through hole to electrically connect to one of the conductive rings.

12. The rotating socket as claimed in claim 1, wherein a side of the rotating base that is adjacent to the panel defines a plurality of first receiving grooves for receiving the conductive tabs, a side of the rotating base away from the panel defines a plurality of second receiving grooves for receiving the conductive rings, numbers of the conductive tabs, the first receiving grooves and the second receiving grooves are same, and each of the plurality of first receiving grooves communicates with a second receiving groove through a channel.

13. The rotating socket as claimed in claim 1, wherein the conductive tab has a shape of U with an open end, and the other end of the conductive tab away from the open end has a conductive protrusion.

14. The rotating socket as claimed in claim 1, wherein the locking mechanism is coupled to the housing and comprises a sliding wedge with an inclined surface, a telescopic member, and a button enables the sliding wedge to slide along the housing; the rotating base extends a plurality of limiting protrusions along a circumferential direction, and when the locking mechanism is in the locked state, the sliding wedge abuts against one of the limiting protrusions.

15. The rotating socket as claimed in claim 14, wherein the button comprises a pressing portion, a fixing portion fixed to the housing and a wedge rib, and the wedge rib slides along the inclined surface when the pressing portion is depressed.

16. The rotating socket as claimed in claim 15, wherein the housing defines a button hole for receiving the pressing portion of the button.

17. The rotating socket as claimed in claim 14, wherein the telescopic member is a spring or a resilient cord.

18. The rotating socket as claimed in claim 1, wherein the rotating socket further comprises a bracket, the wiring assembly and the housing are fixed to the bracket.

19. The rotating socket as claimed in claim 18, wherein the bracket comprises an annular frame, a side of the frame adjacent to the housing has a plurality of latching members, a side of the housing adjacent to the frame has a plurality of hooks, the number of hooks is equal to that of the latching members, and each of the plurality of latching members is engaged with one of the hooks to detachably fix the housing to the bracket.

20. The rotating socket as claimed in claim 18, wherein the fixing base further comprises two fixing arms, one end of each of the two fixing arms away from the substrate defines a threaded groove, the wiring assembly is fixed to the bracket by screwing screw into the thread groove.

* * * * *